US007513038B2

(12) United States Patent
Koh

(10) Patent No.: US 7,513,038 B2
(45) Date of Patent: Apr. 7, 2009

(54) METHOD OF CONNECTING ELECTRIC SIGNALS BETWEEN ELECTRONIC APPARATUS

(76) Inventor: Chao-Ming Koh, 4F.-2, No. 82, Dasyue Rd., Hsinchu City (TW) 30080

( * ) Notice: Subject to any disclaimer, the term of this patent is extended or adjusted under 35 U.S.C. 154(b) by 0 days.

(21) Appl. No.: 11/773,791

(22) Filed: Jul. 5, 2007

(65) Prior Publication Data

US 2009/0011652 A1 Jan. 8, 2009

(51) Int. Cl.
*H01R 43/00* (2006.01)

(52) U.S. Cl. ..... 29/854; 29/825; 29/832; 29/874; 439/218

(58) Field of Classification Search ..... 29/825, 29/857–868, 874–885; 439/507, 511–512, 439/218, 640, 11; 361/753, 797, 803, 823; 385/59, 63–65
See application file for complete search history.

(56) References Cited

U.S. PATENT DOCUMENTS 4,856,863 A * 8/1989 Sampsell et al. ..... 385/4
5,555,332 A * 9/1996 Dean et al. ..... 385/53
6,352,372 B1 * 3/2002 Shahid ..... 385/59
6,477,437 B1 * 11/2002 Hirota ..... 700/95
6,572,403 B2 * 6/2003 Reimund et al. ..... 439/507
6,854,901 B1 * 2/2005 Ouchi ..... 385/89
6,908,324 B1 * 6/2005 Morley et al. ..... 439/218
7,093,351 B2 * 8/2006 Kelley et al. ..... 29/749
7,377,034 B2 * 5/2008 Thomason ..... 29/854

* cited by examiner

*Primary Examiner*—Minh Trinh
(74) *Attorney, Agent, or Firm*—Rabin & Berdo, PC

(57) ABSTRACT

In a method of connecting electric signals between electronic apparatus, various signal terminals or sockets used to connecting power supply, audio/video signals, or transmission cables are integrated into a stackable connection terminal interface. Each of the connection terminals provides a plurality of signal transmission paths or contacts, and is electrically connectable at two opposite ends thereof to enable sequential stacking of multiple connection terminals. The electric contacts on the stackable connection terminal are separately preassigned to a different signal transmission path, so that two or more stackable connection terminals in a stacked state may still own respective signal transmission path to ensure independent signal transmission without mutual interference. Therefore, the space occupied by different terminal interfaces is reduced, and a uniformly structured connection interface is provided.

2 Claims, 7 Drawing Sheets

METHOD OF CONNECTING ELECTRIC SIGNALS BETWEEN ELECTRONIC APPARATUS

FIELD OF THE INVENTION

The present invention relates to a method of connecting electric signals between electronic apparatus, and more particularly to a method of connecting electric signals in which various signal terminals for connecting electric signals are integrated into a stackable connection terminal interface, and electric contacts on the connection terminal are separately pre-assigned to a different signal transmission, so that two or more connection terminals may be stacked while still own respective signal transmission path to ensure independent signal transmission without mutual interference.

BACKGROUND OF THE INVENTION

Following the highly developed technology and the high demands for good applicability of commercial products, a plurality of products and techniques in connection with different electronic apparatus and portable electronic apparatus have been developed, including, for example, smart phones, personal digital assistants (PDAs), digital cameras, AV players, portable multimedia players (PMPs), etc. These electronic apparatus and portable electronic apparatus are generally provided at one side or at a bottom with various kinds of terminals or sockets, to which a charger, different peripherals, or a computer connection interface may be connected, so that the electronic apparatus may be recharged, used to output sound and/or image, or connected to a personal computer.

Please refer to FIG. 1 that shows a conventional way of connecting electric signals between a handheld apparatus A and other different electronic apparatus. As shown, the handheld apparatus A is provided at a bottom with a plurality of sockets A1, A2, A3, A4 having different specifications, so that different connection terminals, such as a power cord B1, a headphone B2, a USB cable B3, and a video-out cable B4, are separately plugged into a corresponding one of the sockets A1, A2, A3, and A4. It is noted the connection terminals B1, B2, B3, B4 might vary with different manufacturers, but they should always match the sockets they are connected to. For example, the power cord B1 must be plugged into the socket A1 to recharge the handheld apparatus A, the headphone B2 or a microphone must be plugged into the socket A2 to output sound, the USB cable B3 must be plugged into the socket A3 to connect with a computer C for data transmission, and the video-out cable B4 must be plugged into the socket A4 to connect with a display D for outputting sound and image. When there are still other types of electric signals to be connected, other corresponding sockets of similar or different specifications must be additionally provided on the handheld apparatus A. As a result, a large area at the bottom or the lateral side of the handheld apparatus A would be occupied by these sockets A1-A4 to adversely affect the beautiful appearance of the handheld apparatus A.

Please refer to FIG. 2. There are also different connection terminals provided with similarly configured connectors. In this case, only one socket A1 is needed to provide at the bottom of a handheld apparatus A. However, only one connection terminal could be plugged into the socket A1 each time. For example, when the charger B1 is plugged into the socket A1 for recharging the handheld apparatus A, it is impossible for the headphone B2, the USB cable B3 and the computer C, or the video-out cable B and the display D to plug into the socket A1 at the same time. While this manner of signal connection simplifies the connector structure of different connection terminals B1 to B4 and the socket A1 on the handheld apparatus A, the number of peripherals that could be simultaneously electrically connected to the handheld apparatus A to execute different functions is also reduced, making the handheld apparatus A inconvenient for use and bringing a lot of confusions to users.

As can be found from FIGS. 1 and 2, in the first conventional way of connecting signals, the sockets for different connection terminals or interfaces would occupy a large space on an electronic apparatus, and a user has to carry about multiple sets of cables or connection terminals with him when the electronic apparatus is to be used at another place; and in the second conventional way, since only one type of connection terminal is allowed to connect to the electronic apparatus each time, the applicability of the electronic apparatus is largely reduced.

SUMMARY OF THE INVENTION

A primary object of the present invention is to provide a method of connecting electric signals between electronic apparatus, in which various signal terminals or sockets that are used to connecting electric signals are integrated into a stackable connection terminal interface, so that two or more connection terminals may be stacked for use without occupying a large space.

Another object of the present invention is to provide a method of connecting electric signals between electronic apparatus, in which electric contacts on each connection terminal are electrically connectable at two opposite ends to allow stacking of two or more connection terminals, and the electric contacts are separately pre-assigned to a different signal transmission path each, so that the stacked connection terminals may still own respective signal transmission path to ensure independent signal transmission without mutual interference, enabling the use of a plurality of uniformly structured connection terminals in signal connection.

To achieve the above and other objects, the method of connecting electric signals according to the present invention includes the steps of:

integrating various kinds of signal terminals or sockets for signal connection into a stackable connection terminal that is structurally configured corresponding to a socket on an electronic apparatus; wherein the stackable connection terminal includes a plurality of electric contacts for transmitting and receiving electric signals, and each of the electric contacts is electrically connectable at two opposite ends, so that two pieces of the stackable connection terminals may be stacked and electrically connected to each other;

pre-assigning the plurality of electric contacts to a different signal transmission path each, and electrically connecting each of the electric contacts to a connection interface end via a separate cable, such that the stackable connection terminals in a stacked state respectively own an independent signal transmission path; and providing a joining element to each of two opposite sides of the connection terminal, so that two stackable connection terminals in the stacked state are securely joined together via the joining elements.

The joining element may be a magnetic adherence element, or a mortise-and-tenon joint.

With the signal connection method of the present invention, two or more uniformly structured connection terminals may be stacked to occupy only a limited space on an electronic apparatus while still own respective signal transmission path to ensure independent signal transmission without mutual interference.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

Figure 1:
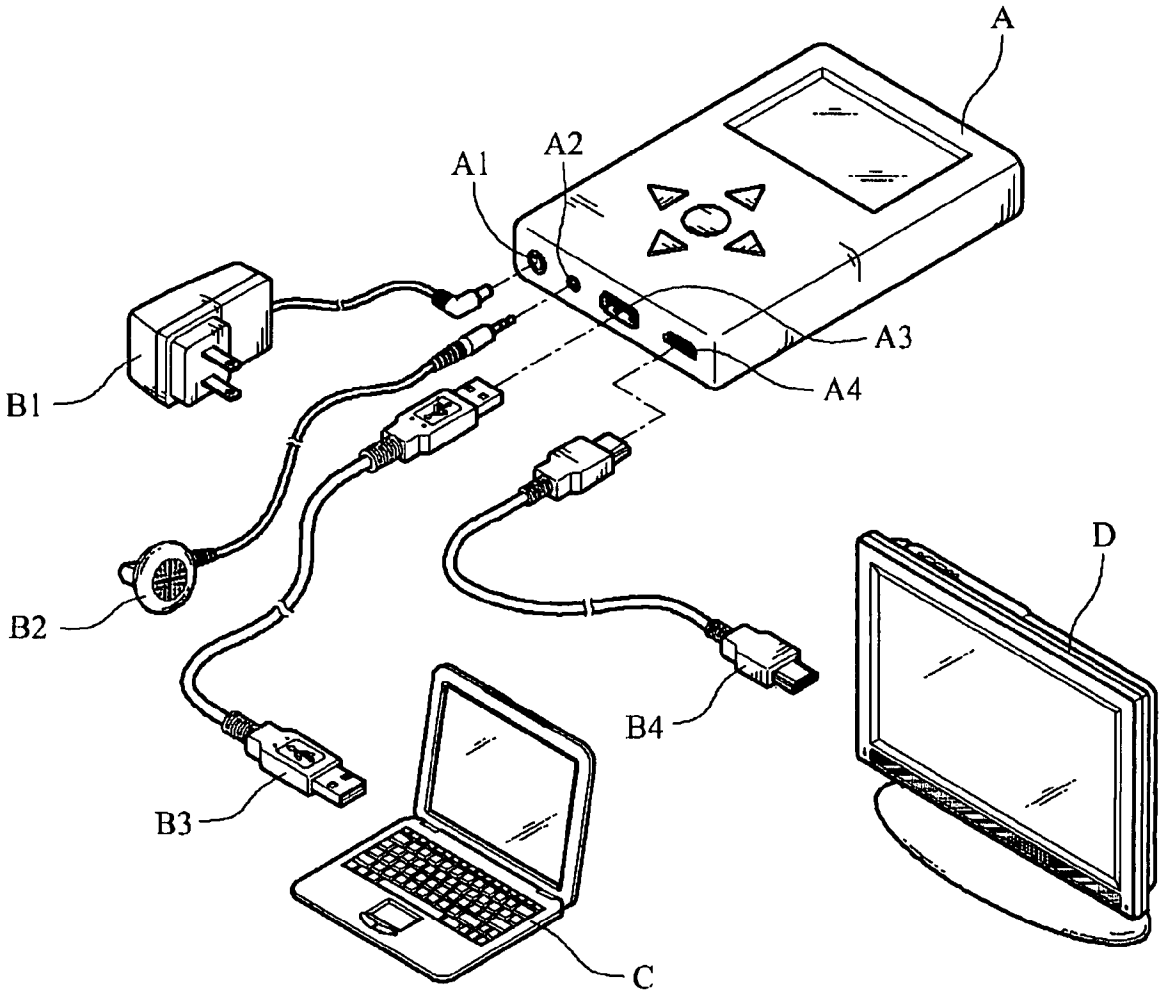
FIG. 1 PRIOR ART
FIG. 1 shows a first conventional method of connecting electric signals between a handheld apparatus and other different electronic apparatus.
Figure 2:
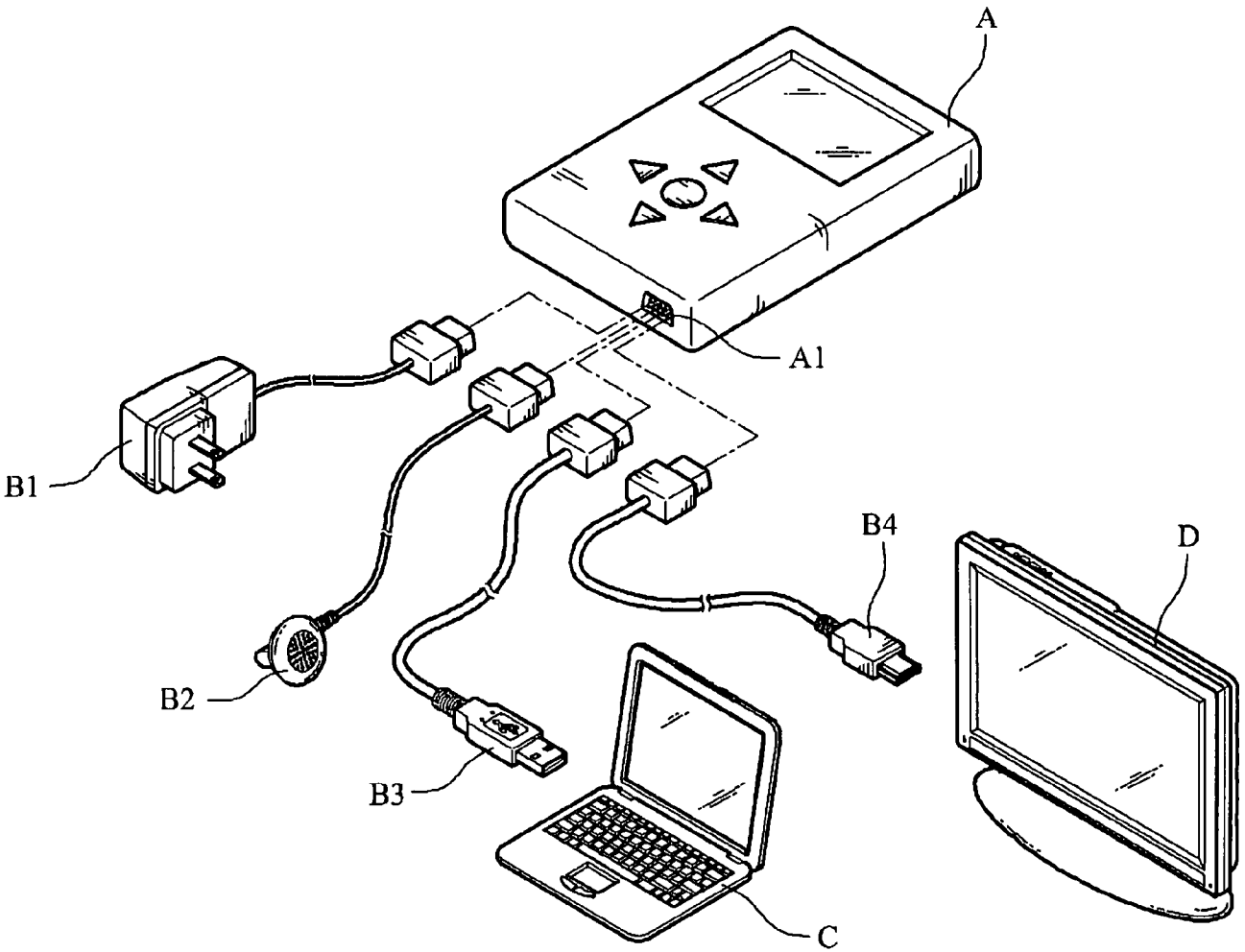
FIG. 2 PRIOR ART
FIG. 2 shows a second conventional method of connecting electric signals between a handheld apparatus and other different electronic apparatus.
Figure 3:
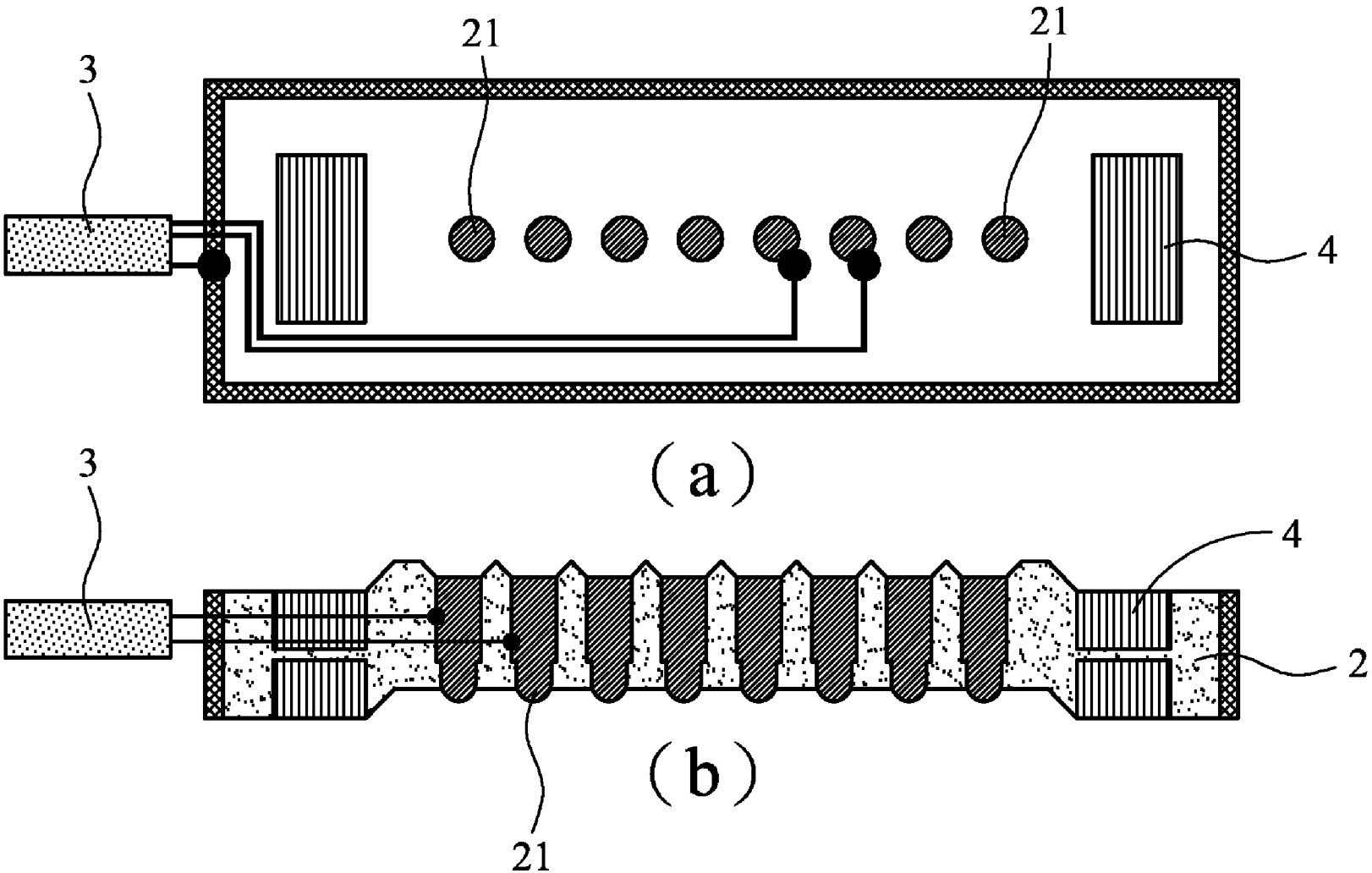
FIGS. 3*a* and 3*b* are conceptual views showing the structure of a stackable connection terminal adopted by the method of connecting electric signals between electronic apparatus according to the present invention.

Please refer to FIGS. 3*a* and 3*b*, in which a stackable connection terminal 2 adopted in a method of connecting electric signals between electronic apparatus according to the present invention is shown. The stackable connection terminal 2 is provided with a plurality of electric contacts 21 enabling signal transmission and signal receiving. Each of the electric contacts 21 has two electrically connectable ends, so that a plurality of stackable connection terminals 2 may be stacked to electrically connect to one another. Each of the electric contacts 21 is pre-assigned to a different signal transmission path, and is connected via a cable 3 to a corresponding connection interface, so that each of the stackable connection terminals 2 in the stacked state still owns an independent signal transmission path. Each of the connection terminals 2 is provided at two opposite sides with a joining element 4 each, so that two stacked connection terminals 2 may be securely joined together via the joining elements 4.

Figure 4:
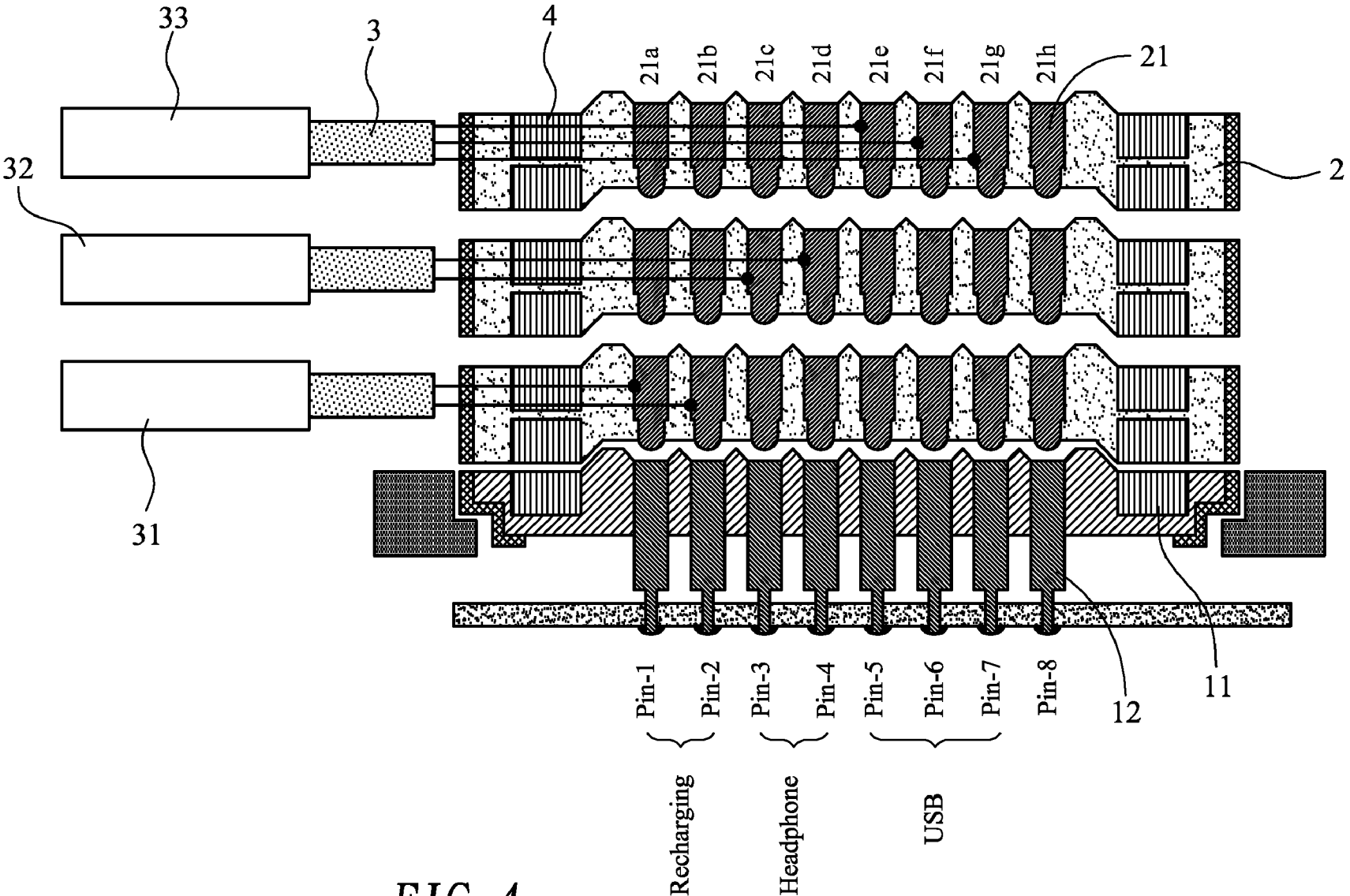
FIG. 4 is a conceptual view showing the electrical connection of a plurality of the stackable connection terminals of FIG. 3 to a corresponding socket and the forming of different signal transmission paths thereof according to the method of the present invention.
Figure 5:
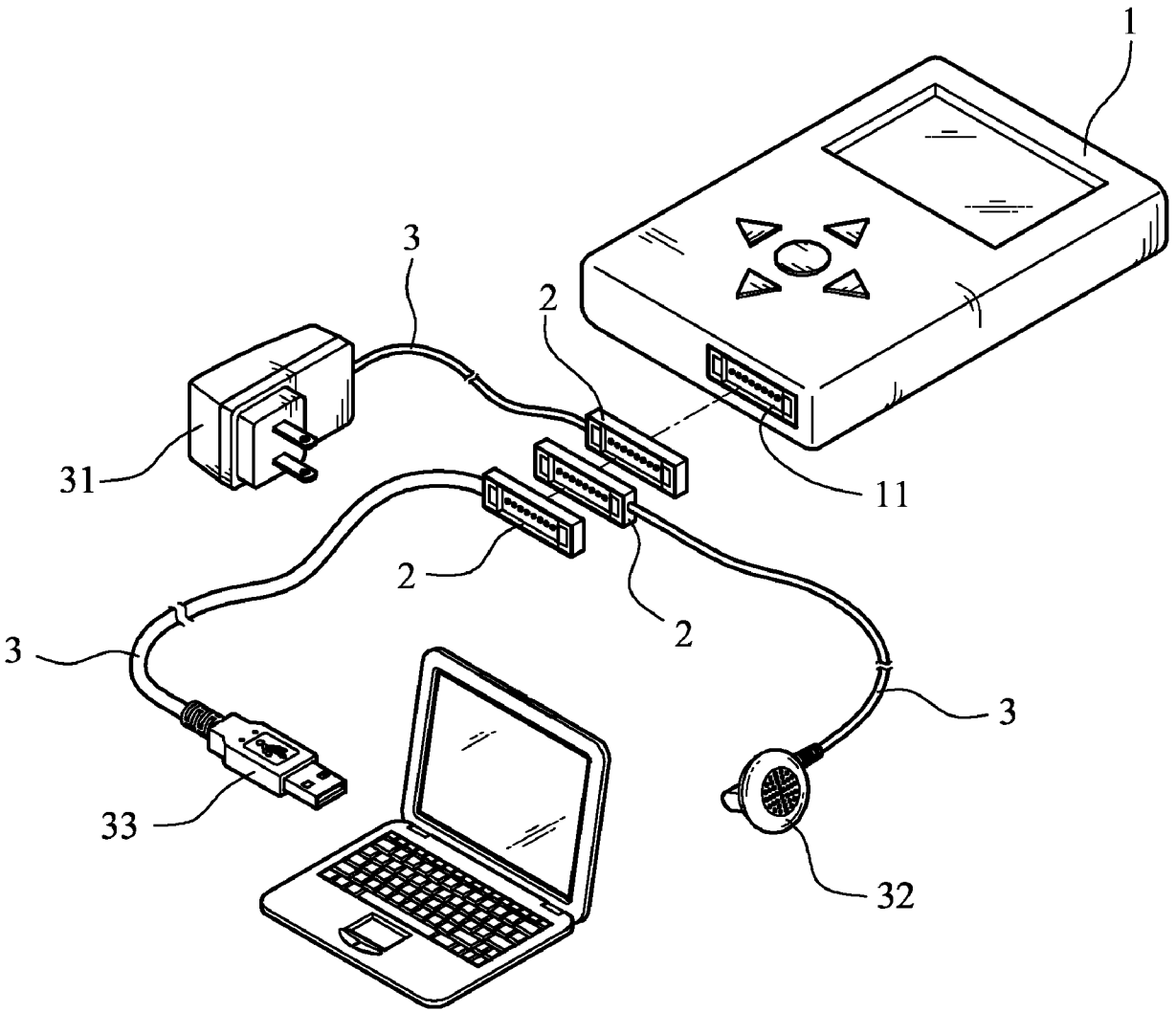
FIG. 5 shows an example of connecting electrical signals between an electronic apparatus and other peripherals in the method of the present invention.

Please refer to FIGS. 4 and 5. To enable connection of electric signals between an electronic apparatus 1 and many other different electronic apparatus in the method of the present invention, the electronic apparatus 1 is provided at a bottom with a socket 11, in which eight electric contacts 12, namely, Pin 1 to Pin 8, are provided. Wherein, Pin 1 and Pin 2 are pre-assigned as contacts for recharging; Pin 3 and Pin 4 for a headphone; Pin 5, Pin 6, and Pin 7 for universal serial bus (USB) connectors to enable data transmission; and Pin 8 for grounding.

For the stackable connection terminal 2 adopted in the method of the present invention to electrically connect to the socket 11 on the electronic apparatus 1, the electric contacts 21 on the connection terminal 2 are separately pre-assigned to a different signal transmission path corresponding to the electric contacts 12 in the socket 11 on the electronic apparatus 1. In the illustrated embodiment of FIG. 4, there are eight electric contacts 21 provided on the stackable connection terminal 2, namely, contacts 21*a* to 21*h*. Wherein, contacts 21*a* and 21*b* are pre-assigned as transmission contacts for recharging; contacts 21*c* and 21*d* for a headphone; contacts 21*e*, 21*f*, and 21*g* for USB connectors to enable data transmission; and contact 21*h* for grounding.

It is understood the number of the electric contacts 12 in the socket 11 at the bottom of the electronic apparatus 1 and of the electric contacts 21 on the stackable connection terminal 2 may be increased depending on actual need, so as to provide independent transmission of video or other signal sources.

To connect electric signals between the electronic apparatus 1 and another desired electronic apparatus in the method of the present invention, a user needs only to electrically connect the stackable connection terminal 2 provided at an end of a connection interface for that desired electronic apparatus to the socket 11 at the bottom of the electronic apparatus 1. For example, when it is desired to recharge the electronic apparatus 1, simply connect a charger 31 to the socket 11. This is because the electric contacts 21*a* and 21*b* on the stackable connection terminal 2 of the charger 31 are pre-assigned as transmission contacts for recharging, allowing the charger 31 to be independently used for recharging.

When it is desired to use the electronic apparatus 1 to receive an audio signal while it is being recharged, the user need not to disconnect the connection terminal 2 of the charger 31 from the socket 11, but may directly stack the stackable connection terminal 2 of a headphone 32 on the stackable connection terminal 2 of the charger 31. At this point, the electric contacts 21 on the connection terminal 2 of the headphone 32 are in contact with and accordingly electrically connected to the electric contacts 21 on the connection terminal 2 of the charger 31, allowing the electric contacts 21*a* and 21*b* as well as the electric contacts 21*c* and 21*d* on the first connection terminal 2 to be independently used for recharging and transmitting signals to the headphone 32, respectively. Since the electric contacts 21 on the connection terminal 2 of the headphone 32 and of the charger 31 have been pre-assigned for transmitting different signals, electric signals to the headphone 32 and from the charger 31 are independently transmitted without conflicting with one another. That is, with the method of connecting electric signals between electronic apparatus according to the present invention, a user is allowed to recharge the electronic apparatus 1 and receive output audio signals from the electronic apparatus 1 at the same time.

The method of the present invention provides more flexibility in its application. For example, the electronic apparatus 1 may be further connected to a computer for data transmission while being recharged and used to transmit audio signals to a headphone. To do so, simply stack another stackable connection terminal 2 connected to a USB interface 33 on the stackable connection terminal 2 of the headphone 32. Since the electric contacts 21*e*, 21*f*, and 21*g* on these stackable connection terminals 2 are pre-assigned for transmitting USB signals, allowing the recharging, the transmission of audio signal source, and the transmission of USB signals to work synchronously but independently without causing mutual interference. That is, with the method of the present invention, the electronic apparatus 1 may be used to synchronously process and connect signals from three different interfaces, so as to achieve the purpose of multiprocessing with one single interface.

Figure 6:
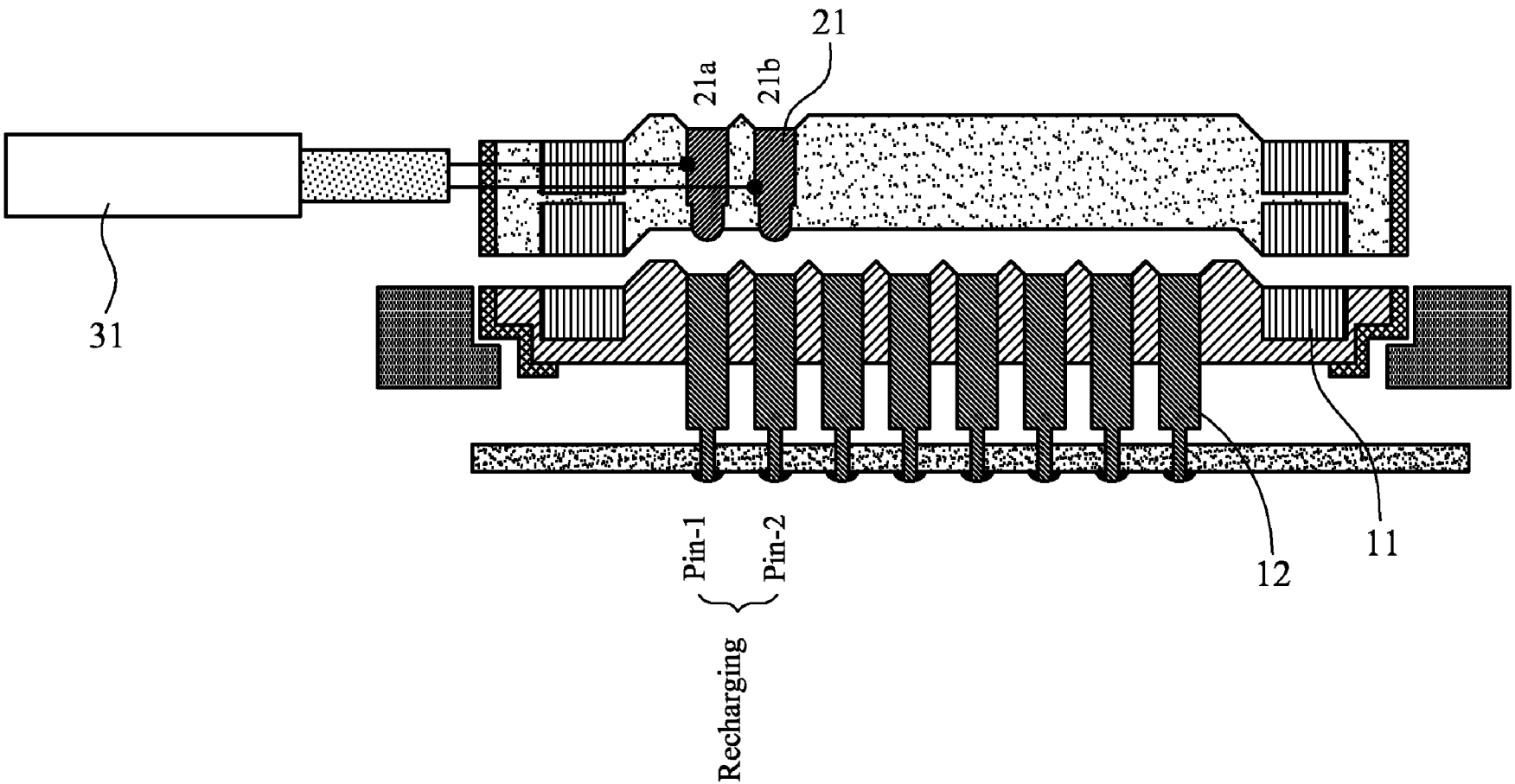
FIG. 6 shows another embodiment of the stackable connection terminal adopted by the method of the present invention for connecting electrical signals between electronic apparatus.

Please refer to FIG. 6. The connection terminal 2 adopted in the method of the present invention may be otherwise designed as an independent interface that does not allow stacking of other connection terminals thereon. In the illustrated embodiment of FIG. 6, the connection terminal 2 for the charger 31 reserves only two transmission contacts 21*a* and 21*b*, all other transmission contacts, including the audio signal and the USB signal transmission contacts, are omitted, so that the charger 31 can only be used to recharge an electronic apparatus independently, and does not allow other connection terminal interfaces to stack thereon for transmitting other electric signals.

Figure 7:
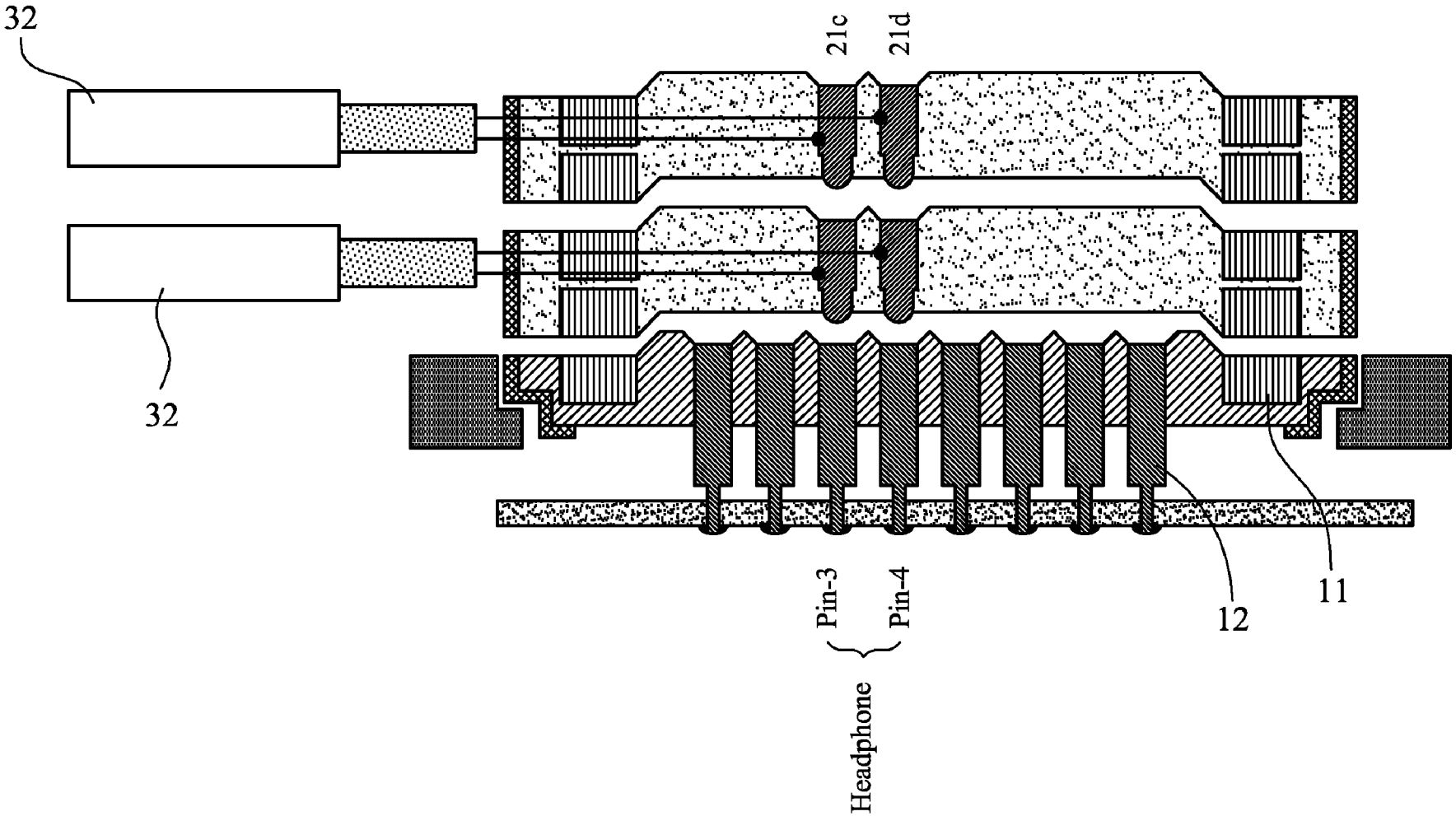
FIG. 7 is a conceptual view showing an example of connecting electrical signals between an electronic apparatus and two headphones in the method of the present invention.

However, in another operable embodiment of the present invention shown in FIG. 7, two headphones 32 with an independent connection terminal 2 each may still be electrically connected to the same socket 11 by sequentially stacking their connection terminals 2 on the socket 11, so that the two headphones 32 are serially connected and audio signals from the same source may be output from the two headphones 32 synchronously. In this manner, two users may share the audio signals at the same time.

To enable the implementation of the signal connection method of the present invention, the stackable connection terminals 2 in the stacked state are securely connected to one another via the joining elements 4 to ensure good electric contact therebetween. The joining elements 4 may be of a magnetic adherence structure, so that any two stacked connection terminals 2 are magnetically adhered to one another via the joining elements 4 provided at two opposite sides of the connection terminals 2, as shown in FIG. 4. Alternatively, the joining elements 4 may be of a mortise-and-tenon joint structure, which also enables two stacked connection terminals 2 to be securely joined together without the risk of separating from one another.

According to the signal connection method of the present invention, various signal terminals or sockets that are used to connecting signals are integrated into a stackable connection terminal interface; each of the stackable connection terminals provides a plurality of signal transmission paths, and all the electric contacts on the connection terminals 2 are electrically connectable at both ends to enable sequential stacking of multiple stackable connection terminals; and the electric contacts on the stackable connection terminals are separately pre-assigned for a different signal transmission, so that the stacked connection terminals may still own respective signal transmission path to ensure independent signal transmission without mutual interference. Therefore, the signal connection method of the present invention not only enables the reduction of space occupied by different terminal interfaces, but also enables the use of uniformly structured connection interface.

The present invention has been described with some preferred embodiments thereof and it is understood that many changes and modifications in the described embodiments can be carried out without departing from the scope and the spirit of the invention that is intended to be limited only by the appended claims.

What is claimed is:

1. A method of connecting electric signals between electronic apparatus, comprising the steps of:

integrating various kinds of signal terminals or sockets for connecting signals into a stackable connection terminal that is structurally configured corresponding to a socket on an electronic apparatus; wherein the stackable connection terminal includes a plurality of electric contacts for transmitting and receiving electric signals, and each of the electric contacts is electrically connectable at two opposite ends, so that two pieces of the stackable connection terminals are stackable and electrically connectable to each other;

pre-assigning the plurality of electric contacts to a different signal transmission path each, and electrically connecting each of the electric contacts to a connection interface end via a separate cable, such that the stackable connection terminal in a stacked state still owns an independent signal transmission path; and providing a joining element, which is a magnetic adherence structure, to each of two opposite sides of the stackable connection terminal, so that two stackable connection terminals in a stacked state are securely joined together via the joining element;

wherein the use of the magnetic adherence structure for the joining element accomplishes a purpose of avoiding a wear and tear effect when attaching and detaching the stackable connection terminals.

2. The method of connecting electric signals between different electronic apparatus as claimed in claim 1, wherein the electric contacts on the connection terminal may be increased in number depending on actual need, so as to enable independent transmission of video signals and other signal sources via the stacked connection terminals.

* * * * *